United States Patent [19]

Wares

[11] Patent Number: 4,869,502

[45] Date of Patent: Sep. 26, 1989

[54] BASKETBALL RETURN APPARATUS

[76] Inventor: Jonathan G. Wares, 2110 W. 31st St., Los Angeles, Calif.

[21] Appl. No.: 237,390

[22] Filed: Aug. 29, 1988

[51] Int. Cl.[4] ..... A63B 69/00

[52] U.S. Cl. ..... 273/1.5 A

[58] Field of Search ..... 273/1.5 R, 1.5 A, 395–397

[56] References Cited

U.S. PATENT DOCUMENTS

| | | | |
|---|---|---|---|
| 1,765,269 | 6/1930 | Hatley | 273/1.5 A |
| 1,924,757 | 8/1933 | Shisoff | 273/397 |
| 3,233,896 | 2/1966 | King | 273/1.5 A |
| 3,342,486 | 9/1967 | Farley | 273/1.5 A |
| 3,776,550 | 12/1973 | McNabb | 273/1.5 A |
| 3,814,421 | 6/1974 | Spier, Jr. | 273/1.5 A |
| 3,901,506 | 8/1975 | Caveney | 273/1.5 A |
| 3,917,263 | 11/1975 | Wiley | 273/1.5 A |
| 4,291,885 | 9/1981 | Cohen | 273/1.5 A |
| 4,579,339 | 4/1986 | Grimm | 273/1.5 A |
| 4,579,340 | 4/1986 | Jenkins et al. | 273/1.5 A |
| 4,667,957 | 5/1987 | Joseph | 273/1.5 A |
| 4,678,189 | 7/1987 | Koss | 273/1.5 A |
| 4,697,810 | 10/1987 | Mathison | 273/1.5 A |
| 4,706,954 | 11/1987 | Kershaw | 273/1.5 A |
| 4,714,248 | 12/1987 | Koss | 273/1.5 A |
| 4,720,101 | 1/1988 | Farkas | 273/1.5 A |

FOREIGN PATENT DOCUMENTS

| | | | |
|---|---|---|---|
| 2626022 | 6/1976 | Fed. Rep. of Germany | 273/396 |
| 1319878 | 6/1987 | U.S.S.R. | 273/1.5 A |

*Primary Examiner*—Paul E. Shapiro

*Attorney, Agent, or Firm*—Ian C. McLeod

[57] ABSTRACT

A lightweight portable apparatus for retrieving a basketball (101). The apparatus includes a frame or support assembly (10) and a trough track assembly (42) removably mounted on the support assembly. The trough track assembly includes spaced apart tubes (50L and 50R) on which the basketball rides, panels (44L and 44R) mounted on the tubes, and track extender modules (56L, 56R, or 54) which extend the ball's delivery to left, right, or center court.

18 Claims, 3 Drawing Sheets

44L
44R
101
44A
44A
44B
44B
44C
50L
50R
44C
54
55

BASKETBALL RETURN APPARATUS

BACKGROUND OF THE INVENTION (1) Field of the Invention

This invention relates to basketball training devices, especially to a basketball return apparatus for use by a player in practicing field goal and free-throw shooting to improve shooting accuracy ultimately measured by a player's scoring percentage.

(2) Prior Art

Many, if not most basketball players prefer to remain at one position at a time on the court during shooting practice. This is not due to athletic indolence but is a result of rather sound judgment about what is required of performance setting events in order to learn reliable shooting habits.

For a player's acquiring the motor skill of basketball shooting accuracy, what is required for most efficient response acquisition would be the maintenance of relatively constant performance setting events during what is essentially a trial and error process of learning a perceptual motor skill congruently involving the coordination of body, mind, and spirit in the rhythm of shooting.

Ideally, for most efficient habit formation, a ball should be returned to a player in a reliably similar manner which minimizes events setting up a player's extraneous arhythmic motions such as bending, stretching, stumbling, or chasing for the ball and maximizes events setting up his shot oriented rhythm of catching, aiming, and shooting the ball.

Heretofore, a variety of basketball returns or ball retrieval devices have been proposed and implemented for redepositing a basketball with a player.

One such apparatus, as disclosed in U.S. Pat. No. 4,579,340 to Jenkins and Jenkins, comprises a vertically extending chute projecting upwardly from the base, positioned on the floor, for receiving balls, and a horizontal ball collection and dispersion tube, with a power-operated plunger mounted in the base swinging about a vertical axis, for receiving and directing balls to various on-court locations. There are problems because of the limitation imposed by the apparatus requiring an external power supply, not easily accessible indoors without additional equipment such as power extension cables with the appropriate type of plug for an available electrical outlet, and typically useless outdoors where such outlets are normally unavailable without provision of additional equipment such as a gas-powered electrical generator and fuel to power it. Without use of a truck, users have the added problems of how to transport and where to store such a large type of apparatus when not in use. The device is also expensive.

Another simpler apparatus is disclosed in U.S. Pat. No. 3,814,421 to Spier, Jr. and includes a lightweight chute with a curved body portion of substantially shape-retentive flexible material nesting in a circumferentially notched ring and angularly adjustable by fitting its mating tooth into different notches of the ring which is attached to the backboard or suspended by hooks from the hoop. As with other apparatus of the type which depend from the hoop, there are problems with the deviation in the regulation size foramen of the hoop as a consequence of attachment of the apparatus's hooking members. No longer are users assured that the encumbered goal assembly will respond in a normal manner to the impact of a ball striking it. Attachment to the backboard, while resolving this problem, leaves users with the prospect of having to alter the integrity of the backboard in an adaptive way to accommodate the attachment means of the apparatus. Yet another problem is that, even when attached to the backboard, the user's view of the hoop and net is substantially obscured by the apparatus, again resulting in the goal assembly being significantly altered in its standard appearance as a regulation goal.

More significantly, users of the Spier device have a problem with the fixed lateral run such apparatus afford the ball whereby its momentum can deliver it with similar efficiency only to a fixed range of different positions on court. While in position to utilize the apparatus near the goal, players find it impossible to take shots from positions progressively farther from the goal without equally progressive loss of the apparatus's efficiency returning the ball. Thus, a player stepping back to shoot from a somewhat further position experiences increasingly inconvenient setting events in terms of the speed and height of the ball's delivery.

Yet another lightweight apparatus is disclosed in U.S. Pat. No. 3,901,506 to Caveney and includes a main back frame which is detachably mountable onto a backboard of predetermined vertical dimension and having a pair of side frames outfolding to a position both normal to the main back frame and above and below and alongside the hoop. Flexible netting chute means covers the frames and extends downwardly to attach to means flush with a user's feet on the floor for returning the ball to a player at the free-throw line.

The Caveney apparatus also has problems with accommodability, enabling use only with a backboard of predetermined vertical and thickness dimension, and lacking ease of mountability on the variety of different popular backboards having various other measures of these dimensions particularly the goal support assemblies to which they are attached.

Another limitation of the Caveney apparatus is that the ball is deliverable only to a player on the straightaway from goal to foul line and positions on right and left court are without delivery service. In addition, during normal use of the apparatus, with both side panels typically outfolded for free-throw shooting, a user desiring to practice shooting from substantially right or left court finds both his view and the ball's access path to the goal substantially limited.

More importantly, the Caveney apparatus delivers the ball at the player's feet, rolling rather than bouncing it to a player standing at or beyond the foul line. This setting event necessitates the player bending over and stretching down each time the ball returns to pick it up. Straightening up to resume his normal shooting stance, the player then has to reset himself to restart his shooting rhythm for the next shot. Players, accustomed to receiving the ball in the course of the game on a vigorous bounce, have a problem with the setting event of receiving a ball on a roll because it causes an interruption of their shooting stance with each practice trial and never allows them to establish a shooting rhythm catching, aiming and shooting the ball.

It is an established principle of the psychology of motor skill learning that response acquisition is enhanced to the extent that performance setting events are similar from trial to trial during practice. Most players, therefore, would find it desireable to have a training device which would facilitate this learning principle and could deliver the ball to a player in a reliably similar, efficient, and convenient fashion.

Other patents of interest are: U.S. Pat. Nos. 1,765,269 to Hatley; 3,917,263 to Wiley; 4,579,339 to Grimm; 4,291,885 to Cohen; 4,720,101 to Farkas; 4,697,810 to Mathison; 4,706,954 to Kershaw; 4,714,248 to Koss; 4,678,189 to Koss; 3,233,896 to King; 4,667,957 to Joseph; and 3,776,550 to McNabb.

It is therefore an object of the present invention to provide a basketball retrieving apparatus which can be adjusted to be easily mounted and demounted from a conventional basketball backboard, regardless of the thickness of the backboard including any thickness added by the goal support assembly to which the backboard is mounted. It is further an object to provide a ball retriever apparatus adaptable to backboards varying in their vertical dimension. Further still, it is an object to provide a ball retriever which can be characterized in that the hoop and net of the goal assembly on which it is mounted is free from any and all encumbrances by the retriever apparatus, thereby ensuring the hoop and net being free to respond normally to the impact of the ball and presenting, for and during optimal use of the retriever, a substantially clear viewing path to the hoop and net from locations on-court circumscribed by a 180° arc in front of and alongside the backboard. Further, it is an object to provide a ball retriever apparatus with rigid ball collection and return means which guides a ball, including a missed shot entering said means in front of the goal, speedily downward by means of an extensible track which redeposits the basketball on a vigorous bounce to a player for a variable range of different locations. Further still, it is an object to provide a ball retriever apparatus with alternative, left and right court oriented track extender modules which can deliver the ball to other positions on court than those at a point perpendicular to and in the front and center of the goal. Also it is an object to provide a ball retriever which can allow players to stand beneath it close to the hoop to set up for practicing hook shots after receiving the ball directly from the apparatus. Further still, it is an object to provide a ball retriever apparatus designed for ease of assembly, adjustment, attachment, and detachment. The retriever apparatus is constructed so that it may be readily set up for use and as readily broken down and nested for transportation in which significant parts are hinged or telescoped together so that they may be folded and compressed into a compact substantially flat package for transport.

The means by which the foregoing and other objects and advantages of the invention are accomplished, and the method of their accomplishment, will be readily understood from a consideration of the following description and the accompanying drawings.

IN THE DRAWINGS

FIG. 1 is a perspective view of an assembled basketball retriever apparatus according to the invention mounted on a backboard 100 (shown in dotted lines) particularly showing a track extender 54 at the end of a trough track assembly 42.

Figures 1, 2, 3, 4, 5:
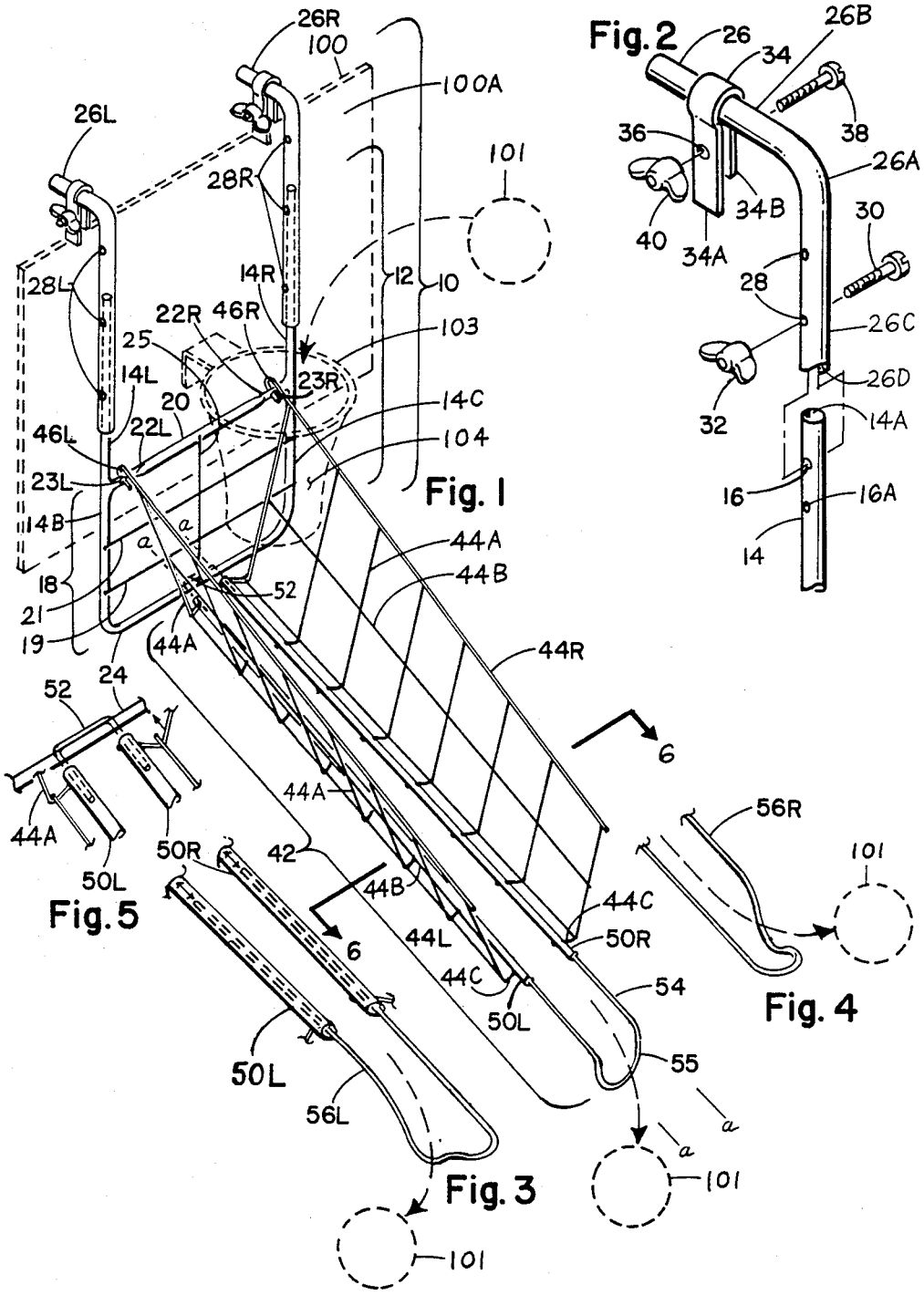
FIG. 2 is a detailed partial perspective view of an upper stanchion 26R of the support assembly 10 of the basketball retriever apparatus shown in FIG. 1.
FIG. 3 is a partial perspective detailed view of the full length (shown in dotted lines) of a left track extender module 56L according to another embodiment of the track extender 54 of the retriever of FIG. 1.
FIG. 4 is a partial perspective detailed view of a right track extender module 56R as another embodiment of the track extender 54 of the basketball retriever of FIG. 1.
FIG. 5 is a partial perspective detailed view of the track anchor 52 for the trough track assembly 42 of the basketball retriever assembly of FIG. 1.
Figure 6:
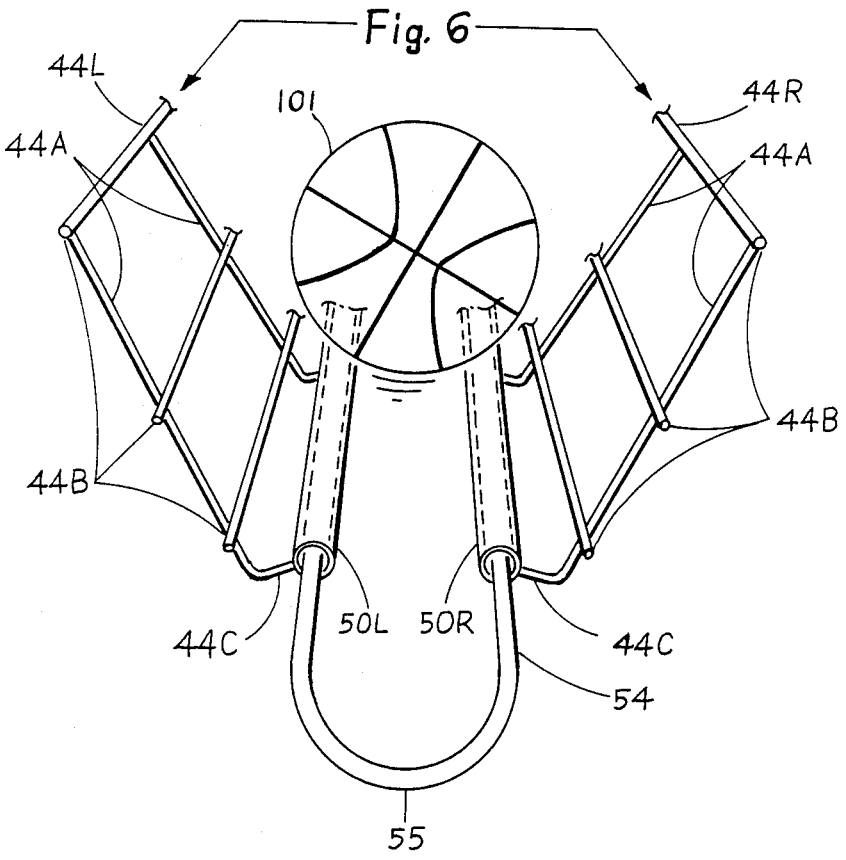
FIG. 6 is a detailed partial perspective cross-sectional view along line 6—6 of FIG. 1.
Figure 8:
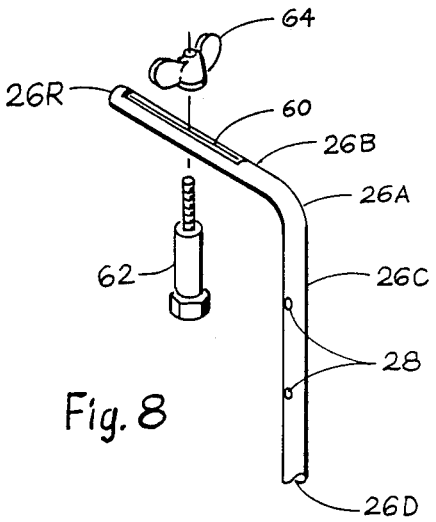

FIG. 8 is a detailed partial perspective view of an upper stanchion 26R particularly showing bolt 62 adjustably secured in a slot 60 as another embodiment of clamp 34 shown in FIG. 2.

Figure 9:
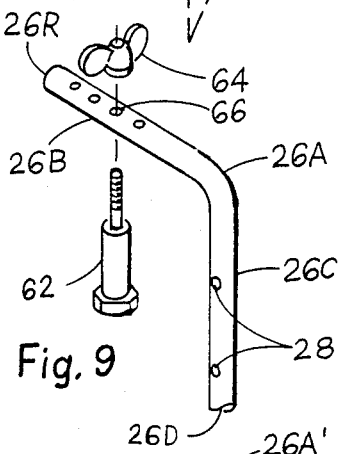

FIG. 9 is a detailed partial perspective view of an upper stanchion 26R particularly showing a bolt 62 secured in a selected hole 66 as another embodiment of clamp 34 shown in FIG. 2.

Figure 10:
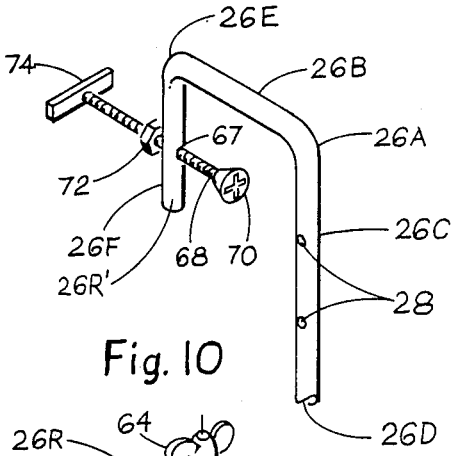

FIG. 10 is a detailed partial perspective view of an upper stanchion 26R' particularly showing a thumbscrew-bolt 68 adjustably secured in a lateral hole 67 as another embodiment of clamp 34 and stanchion 26R shown in FIG. 2.

Figure 11:
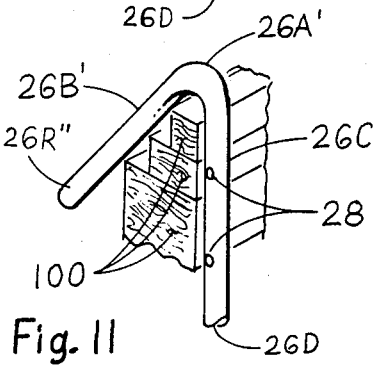

FIG. 11 is a detailed partial perspective (backboard 100 cutaway) view of an upper stanchion 26R" particularly showing portion 26B' forming an inclined hook as another embodiment of clamp 34 and stanchion 26R shown in FIG. 2.

Figure 12:
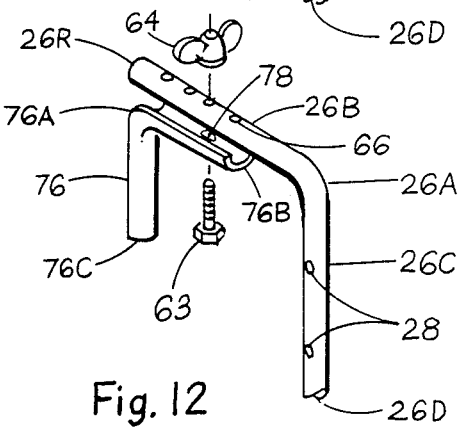

FIG. 12 is a detailed partial perspective view of an upper stanchion 26R particularly showing a tube L-bracket 76 semi-adjustably secured to the underside of portion 26B shown in FIG. 10 as another embodiment of clamp 34 shown in FIG. 2.

GENERAL DESCRIPTION

The present invention relates to an apparatus for retrieving a basketball after it passes through a hoop mounted on a backboard having a top side, an opposed bottom side, and vertical sides between the top side and the bottom sides, and which is mounted on a support means above a floor, which apparatus comprises: support assembly means with a pair of spaced apart vertically oriented frame means on either side of the hoop which are positionable between the hoop and the vertical sides of the backboard and each having an upper end and a lower end, with a holding means on the upper end of the frame means which removably mounts the support means on the top side of the backboard, and with spaced apart horizontally oriented crossbar means joining the frame means together below the hoop; and trough means mounted on the crossbar means so as to be cantilevered from the support means with spaced apart parallel rail means each having opposed proximal and distal ends along axis defined by the rails, with anchor means connecting both of the proximal ends and both of the distal ends of the rail means together, and with panels mounted on either side of the rail means so that a portion of the panels adjacent to each rail means extends below the axis of rail means, wherein the basketball rides on the rail means without riding on the portions of the panels adjacent to the rail means so that the basketball is returned by the trough means with a minimal rolling resistance to the ball.

As shown in FIG. 1, the basketball retriever comprises a support assembly 10 and a trough assembly 42, which can be made of metal, plastic, rubber, wood, or fiberglass. As shown in FIG. 1, and in the detailed view in FIG. 2, the upper part of support assembly 10 comprises a pair of identical upper tubular stanchions 26L (left) and 26R (right), having a plurality of lateral holes 28L (left) and 28R (right) at spaced intervals passing respectively through 26L and 26R for receiving bolts 30, and are secured respectively by wing nuts 32.

Stanchions 26L and 26R are about two feet (61 cm) long and have a substantially right angle bend 26A at the top of each, with a top section 26B transversing a short horizontal distance on which is mounted a tube clamp 34. Each tube clamp 34 has downwardly projecting, flat elongated, sections 34A and 34B about 4 inches (10.2 cm) long, with a lateral hole 36 passing respectively through sections 34A and 34B for receiving a bolt 38 which passes respectively through sections 34A and 34B so that the sections 34A and 34B are clamped respectively by wing nuts 40. A lower portion 26C of the stanchion 26R or 26L extends downward across the front face 100A of the backboard 100.

The lower part of support assembly 10, also shown in FIG. 1, comprises a lower U-frame 12, having a pair of rigid upwardly extending members 14L (left) and 14R (right), each having a series of lateral holes 16 near the top of each, and having an external diameter 14A which is smaller than the diameter of the internal opening 26D of upper stanchion members 26L (left) and 26R (right).

Upwardly extending members 14L and 14R are about 3½ feet (106.7 cm) long and are inserted and slideably positioned, as within a sleeve, in the openings 26D of upper stanchions 26L and 26R in a range of height positions adjustable by means of aligning holes 16 and 28. Holes 16 are aligned with a selected pair of holes 28 and bolts 30 are passed respectively through 16L–28L and 16R–28R thereby affixing 14L and 14R within 26L and 26R.

Upwardly extending members 14L and 14R of U-frame 12 are formed by bending adjacent to lower rung 24, which is a transverse span about 2 feet long (61 cm), so that the members 14L and 14R are parallel to each other and perpendicular to rung 24. A backstop bumper 18 is provided at a lower part of the U-frame 12. Upwardly extending members 14L and 14R are united with an upper crossbar 20. Holes 23L (left) and 23R (right) necessary pass respectively through each swaged (flattened) terminus 22L (left) and 22R (right) of crossbar 20 for hanging modular trough assembly 42. The crossbar 20, wires 19 and 21 and rung 24 with vertical legs 14B and 14C and wire 25 as the backstop bumper 18.

The modular trough panel track assembly 42, as shown in FIG. 1, comprises a pair of synclinally facing, trapezoidally cross-sectioned, grid-like trough panels 44L (left) and 44R (right) cantilevered from the support assembly 10 at a downwardly inclined angle. The panels 44L and 44R are about 3½ feet long (106.7 cm) and comprised of wires 44A and 44B of sufficient strength to be rigid to the impact of a basketball 101 striking the panels 44L and 44R. The uppermost wires 44B of panels 44L and 44R include hooks 46L (left) and 46R (right) which engage crossbar 20, holes 23L and 23R in the crossbar 20. Panels 44L and 44R rest against lower rung 24. Panels 44L and 44R include a pair of tubes 50L (left) and 50R (right). Vertical wires 44A are joined to the tube 50L and to tube 50R so that there are downwardly projecting portions 44C away from tubes 50L and 50R which are about 2 inches (5 cm) long. In this manner the ball 101 does not engage the wires 44A and 44B adjacent the tubes 50L and 50R thereby speeding the ball 101 towards the player. Preferably the axis a—a of tubes 50L and 50R is at an angle of about 10° to 20° from a line perpendicular to the face 100A of backboard 100.

Assembly 42 includes U-shaped proximal anchor 52, as shown in FIG. 1 and detailed in FIG. 5, and a distal anchor as a U-shaped trough extender 54 for tubes 50L and 50R, as shown in FIG. 1. Proximal vertical wire 44A rests against rung 24 to provide backstopping support for trough panels 44L and 44R. The anchor 52 and extender 54 form a two-fold hinge point between panels 44L and 44R, and are held in place by insertion into right and left end openings in tubes 50L and 50R thereby preventing lateral movement and restraining tubes 50L and 50R in mutual parallel relationship.

Anchor 52, which is preferably about 6 inches (15.2 cm) wide between tubes 50L and 50R by about 4 inches (10.2 cm) long. Anchor 52 is preferably shorter in a direction parallel to axis a—a of tubes 50L and 50R than track extender 54, which is of similar width when installed in tubes 50L and 50R. Track extender 54 is splayed outward to form a generally V-shape prior to its slideable insertion into tubes 50L and 50R. Track extender 54 is preferably about 3½ feet long (106.7 cm) from its rounded portion 55 to its divergent points of attachment in tubes 50L and 50R.

Convergent tip 55 of 54 is bent at an angle of about 45°, preferably between about 40° and 50°, in a direction downwardly oblique to the axis a—a of tubes 50L and 50R. As shown in FIGS. 3 and 4 respectively, track extender modules 56L (left) and 56R (right) are additional embodiments of track extender 54 which are alternatively left or right court orienting modules, each potential modular embodiment characterized by the amount of turning of the ball 101 and the left or right guidance direction characteristic.

Basketball Retriever—Operation

As shown in FIG. 1, support assembly 10 is provided with adaptable suspensory means, so as to enable it to be demountably suspended from the top edge of a variously sized conventional basketball backboard 100, and provides means for suspending and supporting the modular trough assembly 42 in position.

The user begins by selecting a goal assembly, including a backboard 100, hoop 103, and net 104, for which he intends to use the basketball retriever. The position of tube clamps 34 is adjusted to accommodate the thickness of the backboard 100 including any thickness added by the goal support assembly to which the backboard is mounted. This is accomplished by sliding clamps 34 on horizontal portion 26B so as to be spaced an appropriate distance away from the lower portion 26C of upper stanchions 26R and 26L. Wing nuts 40 are then tightened on bolts 38 in holes 36, to secure clamps 34 in place. Clamps 34 hold stanchions 26 in position mounted on the backboard 100.

Next, the user adjusts the height of the support assembly 10 to accommodate the specific vertical dimension of the particular backboard 100 of the goal assembly he has selected to use. This is accomplished by rotating upper stanchions 26 (if found in telescoped, flat position collapsed for transport) to be normal to the plane of backstop bumper 18. Selecting the appropriate holes 28, the user then aligns lateral holes 28 in stanchions 26R and 26L with lateral holes 16 in upwardly extending members 14L and 14R and tightens wing nuts 32 on bolts 30, attachment means received by aligned holes 16 and 28, to affix members 14L and 14R inside stanchions 26L and 26R at the proper height to enable crossbar 20 of bumper 18 to be positioned several inches below the hoop 103.

The user hoists up and then lowers support assembly 10 to mount it on the top edge of the backboard 100. This is accomplished by slipping the backboard 100 or the backboard 100 and any goal support (not shown) to which the backboard 100 may be mounted into the gap between the tube clamps 34 and upper stanchions 26L and 26R. Smaller players may utilize the aid of a ladder. The modular trough assembly 42 has the hooks 46L and 46R as suspensory means for depending from support assembly 10 in position below the hoop 103 and has extenders 54, 56L or 56R for extending the redepositing of a basketball 101 to a player.

Nested for transportation, trough assembly 42 is in its flat, telescopically compressed position. Unfolding trough assembly 42 from its collapsed position, the user rotates trough panels 44L and 44R about anchor 52 and extender 54, until they are configured to form a trough shape with runway tubes 50L and 50R forming a parallel track.

The user next hoists the modular trough panel track assembly 42 and suspends it from the support assembly 10. This is accomplished by inserting the hooks 46 through the back of holes 23 in crossbar 20 and by pivoting track assembly 42 downwardly into position to rest against lower rung 24 of backstop bumper 18.

Backstop bumper 18 has a grid-like cross-bracing framework, including horizontal wires 19 and 21 and vertical wire 25 that coacts with assembly 42 to collect the ball 101.

Panels 44, as rigid ball collection means, function to guide the ball 101, including a missed shot entering said means extending in front of the goal, onto runway tubes 50.

Users should select the appropriate extender module 54, 56L or 56R and adjust its length by sliding it in or out of runway tubes 50 in accordance with the degree of extension desired in order to maintain the setting event of the ball 101 returning to the hands comfortably and efficiently with speed and vigor. The user pushes the extender 54, 56L or 56R in towards the backboard 100 for practicing the rhythm of closer shots and out for practicing the rhythm of more distant shots.

By pushing track extender 54, 56L or 56R in to its minimum extension, smaller players can stand beneath the assembly 42 and set up for practicing hook shots after receiving the ball 101 directly from the module.

The ball retriever according to the invention operates in manner characterized in that the hoop 103 and net 104 of the goal assembly on which it is mounted have freedom from any and all encumbrances of the retriever thereby ensuring the hoop 103 and net 104 being free to respond normally to the impact of the ball 101 and presenting, for and during optimal use of the retriever apparatus, a substantially clear viewing path to the hoop 103 and net 104 from locations on-court circumscribed by a 180° arc in front of the backboard 100.

Users can also adjust the slope of the trough assembly 42 by hanging it from a lateral cross-brace 19 or 21 of the backstop bumper 18 in order to increase its declivity and decrease its lateral run. From the point of view of the user, this should further enhance the range for similarity of vigorous ball 101 return setting events enabling the user to maintain rhythm with even closer shots.

Figure 7:
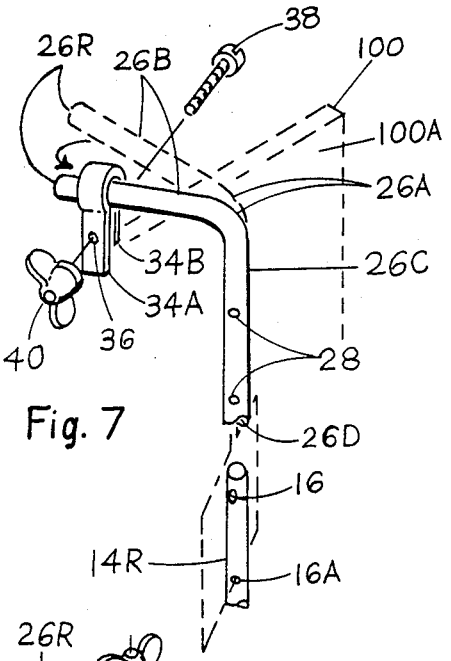
FIG. 7 is a detailed partial perspective view of an upper stanchion 26R with limited rearward space behind backboard 100 rotating to mount at an oblique angle on upper stanchion 14R according to an alternative embodiment of the attachment of stanchions 26R on 14R shown in FIG. 2.

There are many variations on the adjustment mechanism of FIG. 2, e.g. by drilling additional lateral holes 16A slightly below each of holes 16 at an oblique angle, as shown in FIGS. 1 and 7, the horizontal portion 26B of stanchions 26R and 26L can be rotated inwardly nearly 90° from the position shown in FIG. 1 to be at an angle slightly oblique to the plane of backstop bumper 18 to enable the ball retriever to be mounted on a, e.g. wall-mounted, backboard having limited rearward space for mounting.

In another variation, as shown in FIG. 8, there can be a medial slot 60 along the portions of upper stanchions 26L and 26R through which can be passed a bolt 62 secured by a wing nut 64. Or as shown in FIG. 9, a plurality of spaced holes 66 in which a bolt 62 is repositionable can be used in portion 26B in place of clamps 34. Or as in FIG. 10, a thumbscrew-bolt vice clamp can be fashioned at the tops of stanchions 26R' by extending the length of portion 26B shown in FIG. 2 and by making a substantially right angle bend 26E near the middle with lower portion 26F extending downward to form a hook which can receive, wedged into the gap between 26F and 26C, the top of a backboard for mounting. To ensure a tight grip, a hole 67 can be made in lower portion 26F for receiving a thumbscrew-bolt 68 with a bar top 74 for manual turning and a foot 70 for a barrier united to it and a nut 72 or a threaded grommet (not shown) congruently united with lateral hole 67 to provide a clamping means.

In fact, any type of protrusion on the underside of the portions 26B of upper stanchions 26 for limiting the depth of the gap for mounting can be provided as an alternative on FIG. 2. Considering FIGS. 8 and 9, protruding bolt 62 can be replaced, by a tube L-bracket 76 crushed to conform with the rounded underside of portion 26B, as shown in FIG. 12, or by a flat bar L-bracket (not shown), having a substantially right angle bend 76A at the middle with a lower portion 76C extending downward and with a top section 76B having a hole in it and transversing a short horizontal distance whereby 76B can be repositionably mounted on the underside of portion 26B by hole 78 being aligned with a selected hole 66 in order to receive a bolt 63 so that sections 76B and 26B are clamped by wing nuts 64 enabling the ball retriever to be mounted on a backboard having particularly limited space for mounting.

Alternatively, by making portion 26B emerge from bend 26A at a downward oblique angle, upper stanchions 26R'' can be formed to integrally incorporate the necessary protrusion. For example, as shown in FIG. 11, portion 26B' can be bent at a downwardly oblique angle rather than perpendicular angle to upright portion 26C with the forward or proximal part of portion 26B' close to the bend 26A' of 26 and the rearward or distal part thereof away from the bend so that the top of backboards of varying thicknesses can be wedged into the triangular gap and controlled by the fore and aft position of portion 26B' when mounting.

While the above description contains many specificities, these should not be construed as limitations on the scope of the invention, but merely as exemplifications of preferred embodiments thereof. In an alternative embodiment of the invention, for instance, a repetition of crossbar 20 could replace wires 19 or 21 of bumper 18, with holes for hooks 46. Those skilled in the art will envision many other variations within its scope. For example skilled artisans will readily be able to change the dimensions and shapes of the various embodiments. They will also be able to make the ball retriever of alternative materials such as fiberglass, plastics, rubber, and alloys of these or metals like steel such as tungsten-aluminum or other alloys, and with alternative protective coatings like zinc such as chrome or variously colored vinyls.

It is intended that the foregoing description be only illustrative and that the present invention be limited only by the hereinafter appended claims.

Trough assembly 42 can be readily unhooked from support assembly 10 and easily collapsed by pushing extender 54 or 56L or 56R into tubes 50L and 50R to its minimum extension and, by rotating around the restraining rods, anchor 52 and anchor/extender 54 or 56, trough panels 44 can be folded flat and nested against each other. Support assembly 10 likewise has collapsibility and foldability. After demounting from the backboard, support assembly 10 can be collapsed by removing bolt attachment means 30 and by pushing upper stanchions 26 of support assembly 10 down to their minimum extension and rotating them to lie flat within the plane of backstop bumper 18. Collapsibility and foldability ensure easy handling, transport, and storage.

The improved design of the invention provides the advantage of flexibility of utility as a hand portable storage/carriage device. If trough assembly 42 is configured in unfolded syncline position as a bin, by flipping over extender 54 and reinserting it in a downside-up position, several basketballs can be retained for storage or carriage.

I claim:

1. An apparatus for retrieving a basketball after it passes through a hoop mounted on a backboard having a top side, an opposed bottom side, and vertical sides between the top side and the bottom side, and which is mounted on a support means above a floor, which apparatus comprises:

(a) support assembly means with a pair of spaced apart vertically oriented frame means on either side of the hoop which are positionable between the hoop and the vertical sides of the backboard and each having an upper end and a lower end with a holding means on the upper end of the frame means which removably mounts the support means on the top side of the backboard and with spaced apart horizontally oriented crossbar means joining the frame means together below the hoop;

(b) trough means mounted on the crossbar means so as to be cantilevered from the support means with spaced apart parallel rail means each having opposed proximal and distal ends along axis defined by the rails, with anchor means connecting both of the proximal ends and both of the distal ends of the rail means together and with panels mounted on either side of the rail means so that a portion of the panels adjacent to each rail means extends below the axis of rail means, wherein the basketball rides on the rail means without riding on the portions of the panels adjacent to the rail means so that the basketball is returned by the trough means with a minimal rolling resistance to the ball.

2. The apparatus of claim 1 wherein the panels are wires joined together to form each panel.

3. The apparatus of claim 2 wherein some of the wires in the panels are parallel to the axis of the rail means and are joined together by other vertically oriented wires which are connected to each of the rail means on an inside portion of the panel.

4. The apparatus of claim 3 wherein an uppermost of the wires parallel to the axis of the rail means has a hook adjacent the proximal end of the rail means which connects into the crossbar means to hold the trough means in position.

5. The apparatus of claim 4 wherein the trough means can be disconnected from the support assembly for storage.

6. The apparatus of claim 2 wherein an uppermost of the wires has a hook which passes through an opening in a crossbar means below the hoop to hold the trough means in position.

7. The apparatus of claim 1 wherein the distal end of the anchor means has a rounded portion which is directed towards the floor.

8. The apparatus of claim 7 wherein the rounded portion is twisted towards the left or the right to direct the basketball to the left or the right, respectively.

9. The apparatus of claim 1 wherein the frame means are adjustable so that the vertical position of the trough means relative to the floor and hoop can be varied.

10. The apparatus of claim 9 wherein each frame means includes two sections, an upper section and a lower section, one of which telescopes into the other and pin means which pass through aligned holes in each of the sections for adjusting the height of a lower portion of the frame means relative to the floor and hoop.

11. The apparatus of claim 1 wherein the holding means are hooks on the upper end of the frame means which are positioned over the top side of the backboard and behind the backboard.

12. The apparatus of claim 11 wherein the holding means includes tube clamps around on each of the upper ends of the frame means which are adjustable to be slightly larger than a thickness of the backboard alone or the backboard and the support means on the backboard.

13. The apparatus of claim 1 wherein the rail means are tubes and wherein the anchor means are rods having ends in a friction fit with the tubes so that the trough assembly can be folded or disassembled when not in use.

14. The apparatus of claim 13 wherein the panels are wires joined together to form each panel and wherein some of the wires are parallel to the axis of the tubes and are joined together by other vertically oriented wires which are connected to each of the tubes on an inside portion of the panel.

15. The apparatus of claim 14 wherein the distal end of the rod has a rounded portion which is directed towards the floor and wherein the rounded portion directs the ball straightaway from the axis of the tubes or to the right or to the left of the axis of the tubes.

16. The apparatus of claim 15 wherein the frame means are adjustable so that the vertical position of the trough means relative to the floor and hoop can be varied.

17. The apparatus of claim 16 wherein each frame means includes two sections, an upper section and a lower section, one of which telescopes into the other and pin means which pass through aligned holes in each of the sections for adjusting the height of a lower portion of the frame means relative to the floor and hoop.

18. The apparatus of claim 17 wherein the holding means are hooks on the upper end of the frame means which are positioned over the top side of the backboard and behind the backboard.

* * * * *